United States Patent [19]

Kunz

[11] 4,049,487

[45] Sept. 20, 1977

[54] APPARATUS FOR PRODUCING HONEYCOMB PANELING

[76] Inventor: Bernard P. Kunz, 1609 Cague Drive, NE., Albquerque, N. Mex. 87110

[21] Appl. No.: 597,409

[22] Filed: July 21, 1975

Related U.S. Application Data

[63] Continuation of Ser. No. 391,678, Aug. 27, 1973, abandoned, which is a continuation-in-part of Ser. No. 166,818, July 28, 1971, abandoned.

[51] Int. Cl.[2] ..... B31D 3/02

[52] U.S. Cl. ..... 156/436; 156/164; 156/176; 156/324; 156/494; 156/551

[58] Field of Search ..... 156/164, 176, 177, 178, 156/197, 285, 324, 433, 436, 494, 497, 539, 547, 551, 578

[56] References Cited

U.S. PATENT DOCUMENTS

| | | | |
|---|---|---|---|
| 2,021,095 | 11/1935 | Ball | 156/164 |
| 2,404,207 | 7/1946 | Ball | 156/62.2 |
| 3,226.911 | 1/1966 | Vreeland et al. | 156/495 |
| 3,671,355 | 6/1972 | Paymal | 156/324 |
| 3,676,268 | 7/1972 | Brandenburg et al. | 156/548 |
| 3,688,688 | 9/1972 | Kerttula et al. | 100/154 |

*Primary Examiner*—Charles E. Van Horn
*Assistant Examiner*—John E. Kittle

[57] ABSTRACT

Method of and apparatus for producing honeycomb paneling comprising the steps of supplying two continuous webs of felted fibrous material, continuously impregnating each web with a liquid resin, continuously applying the webs to the two major faces of a rigid pre-formed honeycomb core having cells extending through its thickness, applying depthwise pressure to the laminated assembly to cause the cell edges to be embedded in the thickness of each web to produce substantial fillets between the webs and cells, and curing the webs in situ to form rigid bonded panel facings of fiber reinforced plastic, and means to carry out the above method steps.

1 Claim, 3 Drawing Figures

APPARATUS FOR PRODUCING HONEYCOMB PANELING

BACKGROUND OF THE INVENTION

This application is a continuation of my copending U.S. patent application Ser. No. 391,678 filed Aug. 27, 1973, now abandoned which is a continuation-in-part of my co-pending U.S. patent application Ser. No. 166,818, filed July 28, 1971 now abandoned.

This invention lies in the field of method and apparatus for producing finished honeycomb paneling from rigid, pre-formed honeycomb core which has preferably been made up to fiber glass reinforced plastic. The invention is directed primarily to a system for continuously applying facing material in its raw state to the major faces of a continuous length of honeycomb core and processing the facing material to a finished state while in contact with the core to define rigid finished faces or skins bonded to the core and unitary therewith.

It is common practice in the corrugated board industry to provide a continuous web of corrugated paper, apply glue to the crests of the corrugations, and apply continuous webs of paper to one or both faces of the corrugated web.

In the honeycomb panel industry it is common to provide skin layers which are usually rigid, apply glue to the skin layers or cell edges or both to secure them to each other. The cores may be paper, metal foil, or fiber glass forming a somewhat bendable but basically rigid core, and the facings are usually stiff sheets of metal or plastic. Because of the rigidity of the components, the cores and skins are normally trimmed to the desired size, assembled into a laminate, and placed in a large press to hold them in assembled relation while the glue is setting. While the products are generally satisfactory the differences in the cementing means and the materials of the components produce a reduced bonding effect which must rely on adhesion between different materials. Moreover, the step by step operation means a lower production rate and a higher cost.

SUMMARY OF THE INVENTION

The present invention overcomes the various shortcoming of the prior systems and provides a relatively simple and highly reliable method and apparatus which continually forms finished paneling and processes the facing material from its raw state to finished skins integrally united to the core.

Generally stated, in its presently preferred form, the apparatus which is used in the practice of the method includes an elongate, rigid support platen having a planar upper surface and extending generally horizontally from a first upstream end to a second downstream end, with the length of the platen generally defining a laminating zone. A core transfer unit is located upstream of the platen and is generally coplanar therewith and adapted to deliver a continuous length of rigid, preformed honeycomb core to the laminating zone. A first endless loop platen belt extends a short distance downstream of the plate and a considerable distance upstream of it, and is mounted on a pair of support rollers downstream and upstream of the platen. The upper pass of the downstream portion of the belt travels downstream over the platen, and both passes of the upstream portion are located beneath the core transfer unit and hence at a level lower than that of the platen. An intermediate portion of the upper pass of the belt travels upwrd and forward to join the travel path of the core.

A second endless loop belt overlies the platen and is also trained about upstream and downstream support rollers adjacent to the ends of the platen. Its lower pass is spaced above and parallel to the platen upper surface, and the two belts are arranged to cooperate in holding the paneling components in pressural contact as they pass through the laminating zone.

A first supply reel furnishes a continuous web of felted fibrous material which is continuously deposited on the upstream portion of the upper pass of the first belt, and an applicator continuously applies liquid resin to the web to impregnate it throughout its thickness. The web is then continuously carried by the belt forward and upward and into contact with the lower major face of the core, and they pass through the laminating zone together.

A second supply real furnishes a second continuous web of the same kind of fibrous material which is continuously deposited on the upper pass of the second belt, and a second applicator continously applies liquid resin to this web. The belt then carries the impregnated web around its upstream support roller and down into contact with the upper major face of the core to travel therewith through the laminating zone.

An articulated weight belt is located within the second belt and lies on and travels with the lower pass of the second belt. Thus, uniform depthwise pressure is applied to the assembly in the laminating zone to cause the cell edges of the rigid core to be embedded in the still soft webs. This action produces enlarged fillets which increase the strength of the joint. It has been determined that the cell edges should extend about halfway through the thickness of the webs and that a pressure of about six to eight pounds per square inch of cell edge area is sufficient for the purpose. The embedding of the cell edges does not weaken the webs because their random fibers are merely pressed tighter together, and the thinner but denser material has the same strength.

Any suitable drive means may be employed to actuate the belts and the core transfer unit. A cold curing resin may be used if desired. If a heat curing resin is used, suitable means may be provided for transmitting heat to both belts and thence to the webs. Although dissimilar materials may be used with good results, the best product is obtained when the resin and fiber of the webs are the same as those of the core because the product is completely integral. Glass fiber filaments are preferred for both the core and the web because of their high resistance to deterioration. In order to attain the maximum strength joints it is desirable to incorporate relatively short random fibers in the resin which will then be distributed throughout the fillets to increase their strength.

BRIEF DESCRIPTION OF THE DRAWINGS

Various other advantages and features of novelty will become apparent as the description proceeds in conjunction with the accompanying drawings, in which.

DESCRIPTION OF PREFERRED EMBODIMENTS

Figures 1, 1A:
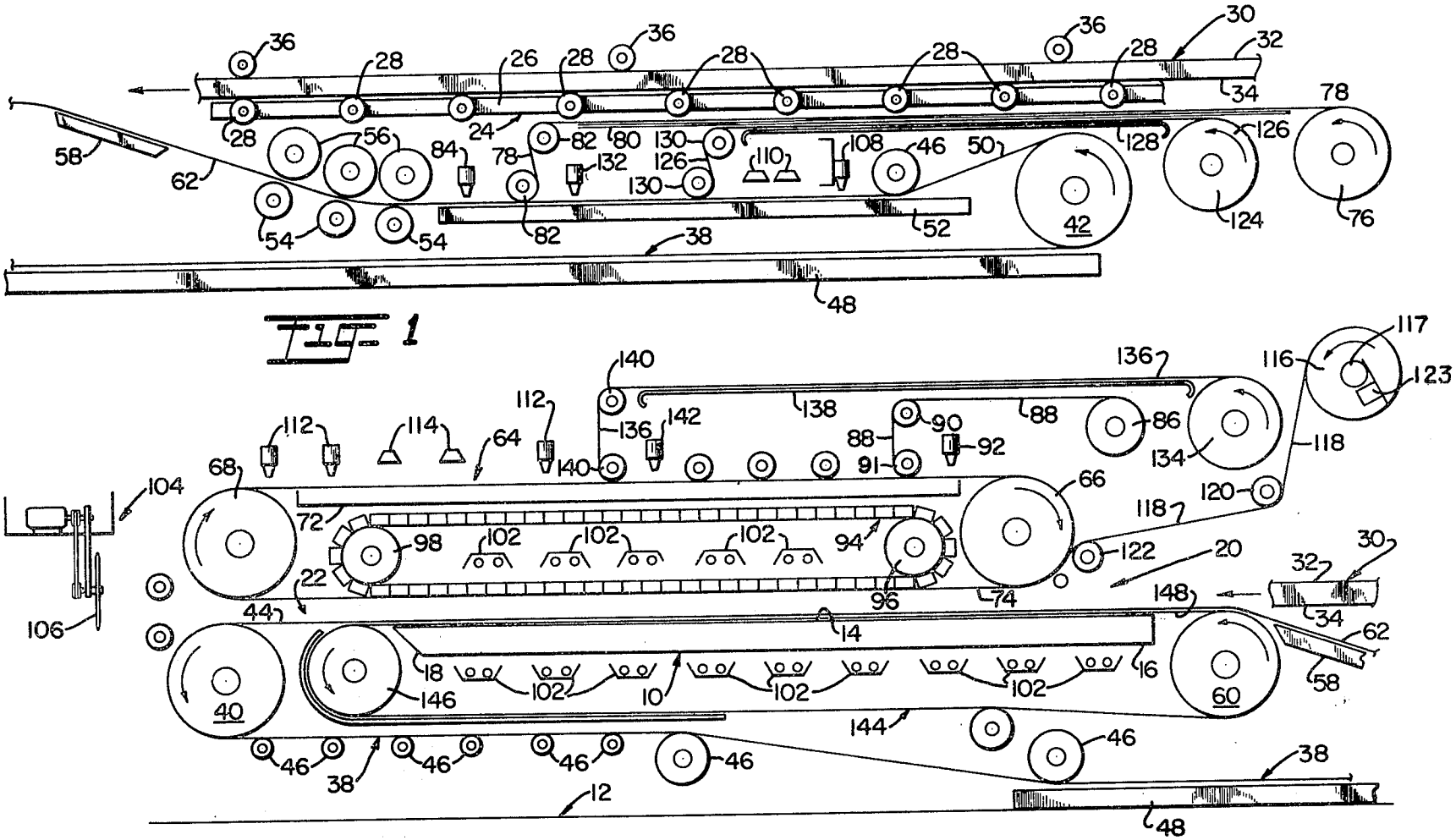
FIG. 1 is a schematic side elevational view of the upstream portion of the apparatus of this invention.
FIG. 1A is a schematic side elevational view of the downstream portion of the apparatus.

A typical example of the apparatus used in the practice of the invention is schematically illustrated in FIGS. 1 and 1A, in which an elongated, rigid support platen 10 is mounted by means, not shown, on a floor 12. The upper surface 14 of the platen is planar and is shown as extending horizontally from a first upstream end 16 to a second downstream end 18, the length of the platen generally defining a laminating zone having an entrance station 20 and an exit station 22. While the platen is preferably horizontal, it may slope upward or downward to some extent without affecting the mode of operation of the apparatus.

A core transfer unit 24 is located some distance upstream from the platen and is substantially coplanar therewith. The unit includes a frame 26 and rollers 28 to support a continuous length of rigid, pre-formed honeycomb core 30 having upper and lower major faces 32 and 34. A set of upper rollers 36 maintain the core in position on rollers 28 and may be powered by any suitable means to drive the core continously downstream to and through the laminating zone.

A first endless loop platen belt 38 extends a short distance downstream of the platen and a considerable distance upstream thereof and is trained about a downstream support roller 40 and an upstream support roller 42. The belt is arranged to encompass the platen, and the upper pass 44 of its downstream portion travels over the platen. The upstream portion of the belt is located beneath the core transfer unit and both passes of the belt lie at a level well below the level of the platen surface. Guide rollers 46 and guide plate 48 generally control the path of travel of the belt.

The upper pass 50 of the upstream portion of the belt is guided horizontally along support plate 52 and thence to a set of rollers 54, 56 which re-direct it forwardly and upwardly over chute 58 to a juncture with the path of the lower face 34 of the core adjacent to entrance station 20 and is guided into parallelism with the core by support roller 60. Thus, the intermediate portion 62 of the upper pass has a path of travel at an upward angle to the rigid core.

A second endless loop belt 64 overlies the platen and is trained about upstream and downstream support rollers 66 and 68 which are adjacent to the entrance and exit stations of the laminating zone. The upper pass 70 travels over support plate 72, and the lower pass 74 overlies and is spaced above and parallel to surface 14 of the platen.

A first supply reel 76 carries a first continuous web of felted fibrous material 78, preferably fiber glass, which passes along a support plate 80 and then down and around guide rollers 82 where it is deposited on pass 50 of the first belt. An applicator 84, which is shown as a spray nozzle but which may be any other suitable type, deposits liquid resin across the width of web 78 as the latter travels forward to enter between rollers 54 and 56. The lower rollers support the belt and web and guide them into their inclined path, while the upper rollers not only guide the belt and web but serve to press the resin into the web to thoroughly impregnate it.

The belt and web continue to travel up the inclined path over chute 58 until the web is brought into contact with the lower major face 34 of the core. They bend over roller 60 into parallelism with the core and then pass through the laminating zone.

A second supply reel 86 carries a second continuous web 88 of the same material as web 78, and web 88 passes around rollers 90 and 91. Roller 91 pushes web 88 firmly down into contact with the upper pass 70 of second belt 64 so that there are no air bubbles betwen the web and belt 74. An applicator 92 applies liquid resin to the web in the same way as applicator 84, and the belt and web then pass together around support roller 66 and down into the path of the core, with web 88 being brought directly into contact with the upper major face of the core. By having web 88 held firmly against belt 74, when the liquid resin is applied there is created an adhesive force between the web and belt which tends to hold the web in a flat configuration along the bottom pass of belt 74 as it is applied to the core, as will be more fully described below.

An articulated weight belt 94 is located within the second belt and is trained about upstream and downstream support rollers 96 and 98, with its lower pass 100 lying directly on the traveling with lower pass 74 of the second belt. The weight belt exerts sufficient pressure on pass 74 to force the cell edges of the core to be embedded in webs 78 and 88 which are still uncured and soft. As the assembly of core 30 and webs 78 and 88 passes through the laminating zone, the resin cures to produce, in situ, rigid skin layers of fiber reinforced plastic on each major face of the core with all components bonded into an integral unit. A cold curing resin may be used, but it is preferred to use a heat curing resin to speed production and to shorten the length of the laminating zone. Any suitable heating means may be used, such as heat lamps 102 which transmit heat to and through the belts of the webs.

A traveling cut-off device 104 is provided to travel longitudinally with the finished assembly and includes a saw 106 which travels laterally at the same time to make a straight cut across the assembly. The saw then returns to its starting point for the neat cut. Details of the cut-off device are fully disclosed in the patent to Bernard F. Kunz, U.S. Pat. No. 2,475,789, issued to the inventor herein on July 12, 1949.

Belts 38 and 64 may be made of any suitable material which is strong enough and flexible enough for the purpose. The material may be resistant to adhesion by the resin or may have a coating which resists adhesion. In the present case the preferred material for the belts is stainless steel. An applicator 108 located downstream of support roller 42 applies a gel coat to pass 50 of belt 38 before it reaches the point where web 78 is deposited on the belt. Pre-heat lamps 110 may be located downstream of applicator 108. Similarly, one or more applicators 112 may be located to apply a gel coat to the upper pass 70 of belt 64 prior to deposit of web 88 thereon, and pre-heat lamps 114 may be provided.

As previously indicated, the fibers of the felted web tend to hold together fairly well while dry because of their length and random arrangement, but when wetted by the resin they become so relatively movable that gravity or centrifugal force acting on the web and resin may be sufficient to pull them apart and disintegrate the web. To avert this possibility a third reel 116 is mounted on a shaft 117 and carries a support web or strip 118 of an open mesh woven fabric, having a mesh on the order of 10 to 25 strands per inch, which passes under roll 120 and over roll 122 into contact with web 88 to support it as it passes along the lower portion of roller 66 into contact with the core face. Strip 118 is incorporated into the panel assembly in the operation.

Conveniently, a drag is applied to shaft 117 by the friction thereof in its support bearings or by a brake, such as brake 123 which frictionally engages the shaft. This drag causes strip 118 to be pulled taut against the lower surface of web 88 as its passes along the lower pass of belt 74. Thus, the tautness of strip 118 together with the adhesion between the web and belt, as discussed above holds the web in planar condition throughout the curing process thereby preventing any sagging of the top skin in the spaces between the edges of the cells of core 30.

Another advantage of the mesh strip 118 is that it acts as a wick which distributes the resin evenly across the bottom. This minimizes dripping of resin from web 88 into core 30 and results in a lesser amount of resin being required per square foot of web 88 being applied.

Even though the finished skin layers resulting from the curing of the resin impregnated webs 78 and 88 present a good appearance, it is often desirable to laminate further layers of a decorative type of these skin layers with solid colors, wood grain prints, or the like.

For this purpose a fourth reel 124 may be provided to carry a first finish strip 126. This strip proceeds across guide plate 128 and down around rollers 130 to be deposited on pass 50 of belt 38 prior to deposit of web 78. An applicator 132 applies resin to the strip which adheres the strip to the web and further insures complete impregnation of the web. Since the strip is next to the belt, it will become the external component on the completed paneling. Similarly, a fifth reel 134 may be provided to carry a second finish strip 136. This strip proceeds across guide plate 138 and down around rollers 140 to be deposited on pass 70 of belt 64 prior to deposit of web 88. An applicator 142 applies resin to the strip of adhering it to web 88 and further impregnating the web.

In operation, the belt 38 travels a considerable distance over platen 10 and is subject to substantial pressure to force the core cell edges to be embedded in the webs. To reduce the wear and tear on belt 38 and also to provide additional power for moving it through the laminating zone, a carrier belt is provided. This carrier belt 144 circumscribes platen 10 and is trained over support roller 60 and support roller 146, with surface 14 on the platen. To reduce the sliding friction of belt 144 on the platen, surface 14 is coated with a suitable lubricant. Any or all of the reels and rollers in the apparatus may be driven by suitable power means, and synchronizing systems may be incorporated where necessary.

Figure 2:
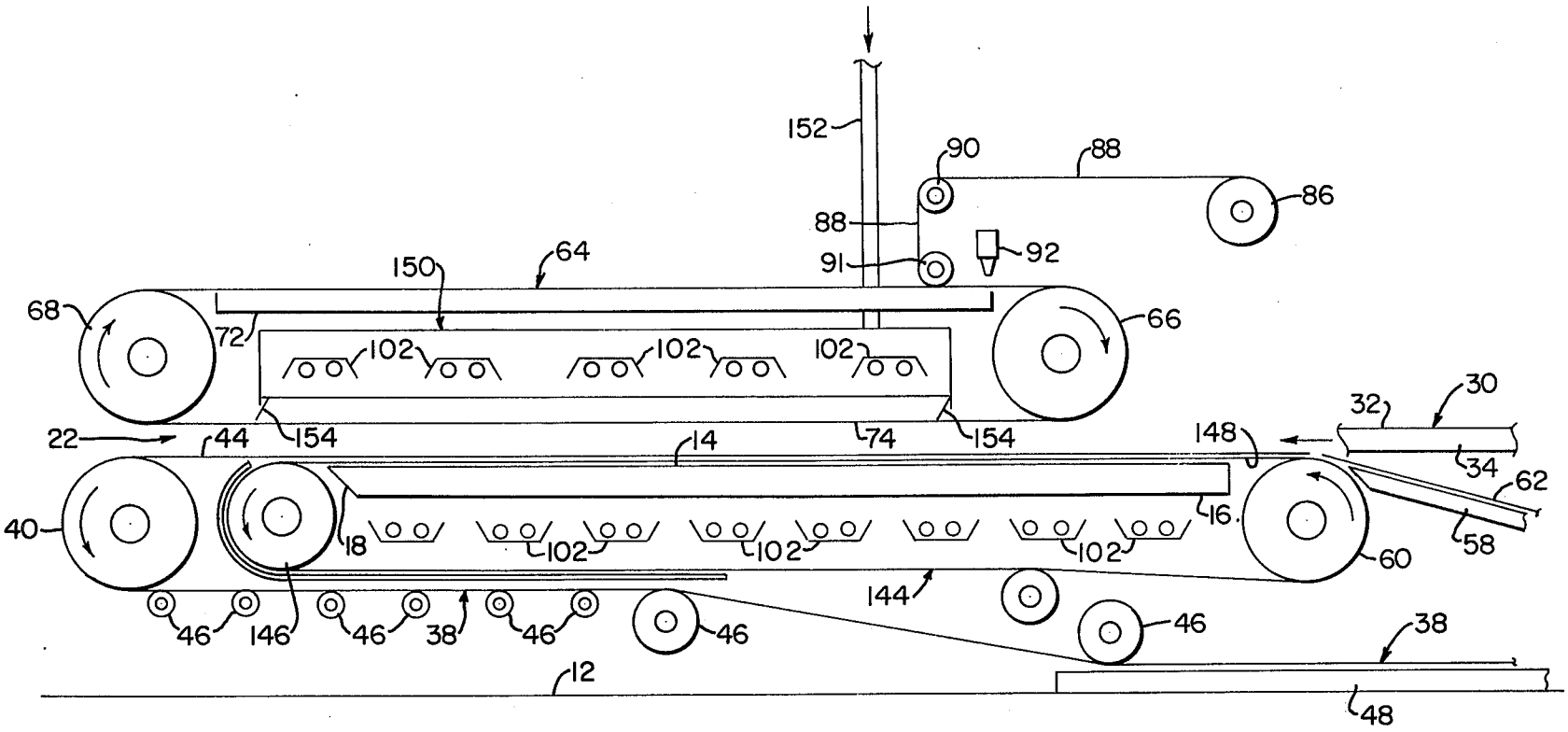
FIG. 2 is a fragmentary schematic side elevation showing an alternative downstream portion for the apparatus.

In the embodiment shown in FIG. 2, the weighted belt 94 of FIG. 1A is replaced by an air pressure box 150 which extends around heat lamps 102 and is supplied with air under pressure through hose 152 at a pressure in the range of 1/6 to ⅓ psi. The bottom box 150 is open, but is spaced closely to the upper surface of the lower pass of belt 74 to exert a force against the upper skin to cause it to be embedded in the edges of core 30 along major face 32 thereof, as described above. It will be understood that the spacing between the bottom of box 150 and belt 74 has been exaggerated for the purpose of illustration. Nevertheless, air will continually escape through the crack so formed. Conventiently, flexible wipers 154 can be provided around the periphery of the lower edge of box 150 if required to more accurately control air leakage so that alignment of the bottom of box 150 with the surface of belt 74 does not have to be precise. In this manner the leakage will be substantially uniform all the way around the box and the force applied by the air will also be uniform.

It will be apparent that the invention disclosed herein provides a method and apparatus for continuously producing completed paneling from a continous length of honeycomb core by forming and finishing, in situ, continuous skins integrally bonded to the major faces of the core.

What is claimed is:

1. Apparatus for producing honeycomb paneling from a continuous length of pre-formed, rigid honeycomb core having open cells therein whose edges form the major faces thereof by applying facing material in its raw state, as a non-rigid web of felted mat material made from glass fibers, to at least the top major face of the core and processing the facing material to its finished state by curing in said apparatus to form a panel skin which is embedded into the core edges, said apparatus comprising:

an elongate, rigid support platen having a planar upper surface and extending generally horizontally from a first upstream end to a second downstream end, the length of said platen generally defining a laminating zone with an entrance station adjacent to the upstream end of said platen and an exit station adjacent to the downstream end;

a honeycomb core transfer unit located upstream of said platen and substantially coplanar therewith and adapted to continuously deliver core material to the laminating zone;

an endless loop belt overlying said platen and trained about upstream and downstream support rollers adjacent to the entrance and exit stations and having an upper pass and a lower pass, said lower pass spaced above and parallel to the platen upper surface;

means to carry and furnish a continuous web of the raw felted facing material to the surface of the upper pass of said belt;

an applicator to deposit liquid resin on the web while it is on the upper pass of the belt;

drive means to cause continuous travel of the core to the entrance station and through the laminating zone and continuous travel of the belt to carry the web around the upstream support roller and along the lower pass thereof into laminating contact with the upper major face of the core while the web is still in its raw state;

means to supply a continuous strip of open mesh woven fabric under tension directly to the side of said web on said belt which is to come into contact with said core adjacent said upstream support roller without said fabric first contacting said upper pass of said belt, said supply means including a reel on a shaft for supporting said fabric and brake means operatively connected to said shaft for applying a frictional force to said shaft to maintain tension on said strip of open mesh woven fabric, to support the lower surface of the web in a planar condition as it comes into contact with the core and to hold it in a planar condition until it is cured in said laminating zone to minimize sagging of the web into the open cells to form an upper panel skin, said fabric being sandwiched between said core and web after lamination; and means for maintaining the web in pressural contact with the core to cause the web to be imbedded in the edge of the core cells to bond the web and core into a unitary assembly during the period of curing of the web.

* * * * *